US012768085B2

(12) United States Patent
Lee et al.

(10) Patent No.: US 12,768,085 B2
(45) Date of Patent: Oct. 20, 2026

(54) POLYETHYLENE MULTIFILAMENT INTERLACED YARN AND METHOD FOR MANUFACTURING THE SAME

(71) Applicant: KOLON INDUSTRIES, INC., Seoul (KR)

(72) Inventors: Sin-Ho Lee, Seoul (KR); Seong-Young Kim, Seoul (KR); Min-Woo Nam, Seoul (KR); Sang-Mok Lee, Seoul (KR); Young-Soo Lee, Seoul (KR)

(73) Assignee: KOLON INDUSTRIES, INC., Seoul (KR)

( * ) Notice: Subject to any disclaimer, the term of this patent is extended or adjusted under 35 U.S.C. 154(b) by 784 days.

(21) Appl. No.: 17/289,733

(22) PCT Filed: Dec. 26, 2019

(86) PCT No.: PCT/KR2019/018514

§ 371 (c)(1),
(2) Date: Apr. 29, 2021

(87) PCT Pub. No.: WO2020/138971

PCT Pub. Date: Jul. 2, 2020

(65) Prior Publication Data

US 2022/0002914 A1 Jan. 6, 2022

(30) Foreign Application Priority Data

Dec. 28, 2018 (KR) ..... 10-2018-0171614
Dec. 24, 2019 (KR) ..... 10-2019-0174354

(51) Int. Cl.
*D02G 3/38* (2006.01)
*D01D 5/088* (2006.01)
(Continued)

(52) U.S. Cl.
CPC ..... *D02G 3/38* (2013.01); *D01D 5/088* (2013.01); *D01D 5/16* (2013.01); *D01F 6/04* (2013.01);
(Continued)

(58) Field of Classification Search
CPC . D02G 3/38; D02G 3/02; D02G 3/442; D01F 6/04; D10B 2321/0211
See application file for complete search history.

(56) References Cited

U.S. PATENT DOCUMENTS

2005/0003182 A1 1/2005 Sakamoto
2005/0118418 A1 6/2005 Sakamoto
(Continued)

FOREIGN PATENT DOCUMENTS

CN 1664185 A 9/2005
JP 60194109 A 10/1985
(Continued)

OTHER PUBLICATIONS

Machine Translation KR 10-2018-0120373 (Year: 2018).*
JP Office Action dated Jun. 21, 2022.
International Search Report dated Apr. 17, 2020.

*Primary Examiner* — Elizabeth M Imani
(74) *Attorney, Agent, or Firm* — Harvest IP Law, LLP

(57) ABSTRACT

In the present disclosure, there are provided a polyethylene multifilament interlaced yarn having excellent weavability as well as enabling the manufacture of a protective product having high cut resistance and excellent fit by giving sufficient entanglements to the polyethylene multifilament yarn, and a method for manufacturing the same.

9 Claims, 1 Drawing Sheet

(51) Int. Cl.

| | |
|---|---|
| ***D01D 5/16*** | (2006.01) |
| ***D01F 6/04*** | (2006.01) |
| ***D02G 3/02*** | (2006.01) |
| ***D02J 1/08*** | (2006.01) |
| ***D02J 13/00*** | (2006.01) |

(52) U.S. Cl.
CPC ..... *D02G 3/02* (2013.01); *D02J 1/08* (2013.01); *D02J 13/00* (2013.01)

(56) References Cited

U.S. PATENT DOCUMENTS

| | | | | |
|---|---|---|---|---|
| 2007/0190321 | A1 | 8/2007 | Sakamoto | |
| 2017/0101727 | A1 | 4/2017 | Fukushima | |
| 2018/0231365 | A1* | 8/2018 | Meinders ..... | G01B 5/068 |

FOREIGN PATENT DOCUMENTS

| | | | |
|---|---|---|---|
| JP | 2003049320 | A | 2/2003 |
| KR | 100943592 | B1 | 3/2006 |
| KR | 1020090049099 | A | 5/2009 |
| KR | 1020100021961 | A | 2/2010 |
| KR | 1020110038688 | A | 4/2011 |
| KR | 20140075842 | A | 6/2014 |
| KR | 10-2016-0056653 | A | 5/2016 |
| KR | 1020160059653 | A | 5/2016 |
| KR | 1020160081518 | A | 7/2016 |
| KR | 1020170037392 | A | 4/2017 |
| KR | 1020180120373 | A | 11/2018 |

* cited by examiner

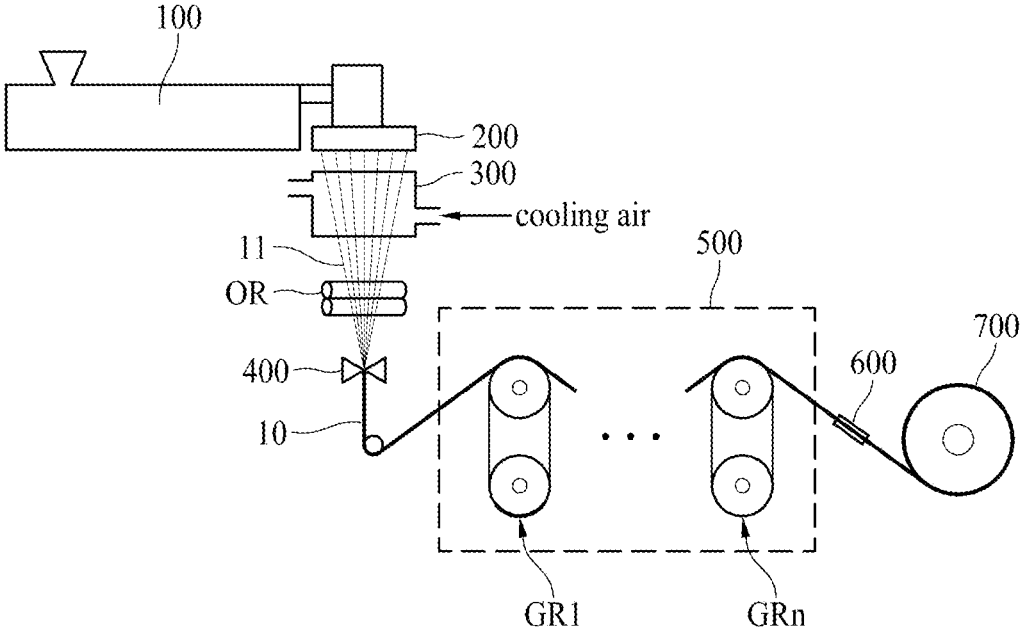
100
200
300
cooling air
11
OR
500
400
10
600
700
GR1
GRn

POLYETHYLENE MULTIFILAMENT INTERLACED YARN AND METHOD FOR MANUFACTURING THE SAME

CROSS REFERENCE TO RELATED APPLICATIONS

This application is a National Stage of International Application No. PCT/KR2019/018514 filed Dec. 26, 2019, claiming priority based on Korean Patent Application No. 10-2018-0171614 filed on Dec. 28, 2018 and No. 10-2019-0174354 filed on Dec. 24, 2019 with the Korean Intellectual Property Office, the disclosure of which is incorporated herein by reference in its entirety.

TECHNICAL FIELD

The present disclosure relates to a polyethylene multifilament interlaced yarn and a manufacturing method thereof. More specifically, it relates to a polyethylene multifilament interlaced yarn having excellent weavability as well as enabling the manufacture of a protective product with high tenacity and high cut resistance, and a method for manufacturing the same.

BACKGROUND OF ART

People with sharp cutting tools in a variety of industries, as well as those in the security field such as police and military personnel are always at risk of injury. Protective products such as gloves or clothing should be provided to minimize the risk of injury.

The protective product is required to have cutting resistance in order to adequately protect the human body from weapons such as knives or sharp cutting tools.

In order to provide high cutting resistance, a high-tenacity polyethylene yarn is used in the manufacture of the protective product. For example, a high-tenacity polyethylene yarn may be used alone for fabrication, or a cabled yarn may be formed of a high-tenacity polyethylene yarn and other types of yarn together, and then used for fabrication.

An ultra-high molecular weight polyethylene (hereinafter, referred to as 'UHMWPE') yarn, which is one type of high-tenacity polyethylene yarn, is generally a yarn formed of linear polyethylene having a weight average molecular weight of 600,000 g/mol or more, and can be produced only by a gel spinning method due to high melt viscosity of UHMWPE. For example, a UHMWPE solution is prepared by polymerizing ethylene in an organic solvent in the presence of a catalyst, spinning and quenching the solution to form a fibrous gel, and drawing the fibrous gel to form a polyethylene yarn having high tenacity and high modulus. However, since this gel spinning method requires the use of an organic solvent, not only an environmental problem occurs, but also enormous cost is required to recover the organic solvent.

In addition, high-density polyethylene, which is generally linear polyethylene having a weight average molecular weight of 20,000 to 600,000 g/mol, has a relatively low melt viscosity compared to UHMWPE, so that melt spinning is possible. As a result, it is possible to solve environmental problems and high cost problems that are unavoidable in the gel spinning method. However, the high-density polyethylene, which is linear polyethylene having a weight average molecular weight of 20,000 to 600,000 g/mol, has a relatively low molecular weight compared to UHMWPE, so that the tenacity of the high-density polyethylene yarn is inevitably lower than that of the UHMWPE yarn.

Accordingly, efforts have been made to improve the tenacity of the high-density polyethylene yarn, and as a result, it has become possible to manufacture a protective product having satisfactory cutting resistance even with the polyethylene yarn manufactured by melt spinning.

Meanwhile, since filaments formed of polyethylene not only have a smooth surface, but also have electrostatic surface properties that cause repulsion between the filaments, cohesion strength between the filaments is generally low. Therefore, it is necessary to perform an interlacing process to increase the cohesion strength between the polyethylene filaments.

However, those developed so far as high-density polyethylene yarns for the manufacture of protective products have not been able to impart sufficient entanglements. Herein, high-pressure air stream can transform the shape of the filaments, making them entangled. However, there are problems in that the conventional high-density polyethylene yarn is difficult to transform itself, and even if the filaments are instantaneously entangled due to high-pressure air stream, the entanglements are weak and quickly released.

In summary, the existing high-density polyethylene yarn developed only for improving the tenacity was able to provide satisfactory cutting resistance to the protection product, but sufficient entanglements could not be given, so the cohesion strength between the filaments constituting the yarn was inevitably low. As a result, in the process of weaving the fabric of the protective product and/or in the process of doubling with other types of yarn, some filament (s) were cut due to friction, and thus a problem of fluffing occurred frequently (i.e., weavability of the yarn was low). The occurrence of such fluff not only causes a decrease in productivity of the fabric and an increase in production cost, but also causes a decrease in quality of the protective product.

DETAILED DESCRIPTION OF THE INVENTION

Technical Problem

Accordingly, the present disclosure relates to a high-tenacity polyethylene multifilament interlaced yarn and a method of manufacturing the same, which can prevent problems due to limitations and disadvantages of the related technology as described above.

In the present disclosure, there is provided a polyethylene multifilament interlaced yarn having excellent weavability as well as enabling the manufacture of a protective product having high cut resistance and excellent fit by minimizing the occurrence of fluff.

In the present disclosure, there is also provided a method of manufacturing a polyethylene multifilament interlaced yarn having excellent weavability as well as enabling the manufacture of a protective product having high cut resistance and excellent fit by minimizing the occurrence of fluff.

In addition to the viewpoints of the present invention mentioned above, other features and advantages of the present invention will be described below, or it will be clearly understood by those of ordinary skill in the art to which the present invention pertains from such description.

Technical Solution

According to an aspect of the present disclosure, there is provided a polyethylene multifilament interlaced yarn including filaments having a weight average molecular weight of 90,000 to 300,000 g/mol, a tenacity of 12 to 20 g/d, and a degree of entanglement of 10 nodes/m or more.

The polyethylene multifilament interlaced yarn may have a degree of entanglement of 20 to 40 nodes/m.

The polyethylene multifilament interlaced yarn may have a degree of entanglement of 30 to 40 nodes/m.

The polyethylene multifilament interlaced yarn may have an initial modulus of 100 to 300 g/d.

The polyethylene multifilament interlaced yarn may have an elongation of 6 to 10%.

The polyethylene multifilament interlaced yarn may have a polydispersity index (PDI) of more than 5 and 9 or less.

The polyethylene multifilament interlaced yarn may include 40 to 500 filaments, wherein each filament has a fineness of 1 to 3 denier, and the polyethylene multifilament interlaced yarn has a total fineness of 100 to 1,000 denier.

According to another aspect of the present disclosure, there is provided a method of manufacturing the polyethylene multifilament interlaced yarn, including the steps of: obtaining a polyethylene melt by melting polyethylene chips having a polydispersity index (PDI) of more than 5 and 9 or less and a melt index (MI at 190° C.) of 0.3 to 3 g/10 min; extruding the polyethylene melt through a spinneret having a plurality of nozzle holes; quenching a plurality of filaments formed when the polyethylene melt is discharged from the nozzle holes; forming a multifilament yarn by collecting the plurality of quenched filaments; drawing the multifilament yarn at a total draw ratio of 11 to 23 times, followed by heat setting; interlacing the drawn multifilament yarn; and winding the interlaced multifilament yarn.

The interlacing step may be performed with an air pressure of 15 to 100 psi.

The drawing step may be performed in multi-stage drawing of 4 stages or more using a plurality of godet rollers, and 0 to 10% of a relax may be applied to the drawn multifilament yarn. The relax is calculated by the following Equation 1.

$$R(\%)=[(V_{max}-V_w)/V_{max}]\times 100 \quad \text{[Equation 1]}$$

In Equation 1, R is a relax, $V_{max}$ is the highest linear velocity among linear velocities of godet rollers, and $V_w$ is a winding velocity.

The drawing step may be performed in multi-stage drawing of 4 stages or more and 20 stages or less.

A tension of 0.1 to 0.5 g/d may be applied to the multifilament yarn during the interlacing step and the winding step.

The heat setting of the multifilament yarn may be performed by the plurality of godet rollers.

The plurality of godet rollers may be set to a temperature of 40 to 140° C., a temperature of the first godet roller among the plurality of godet rollers is may be 40 to 80° C., a temperature of the last godet roller among the plurality of godet rollers may be 110 to 140° C., and a temperature of each godet roller other than the first and last godet rollers may be equal to or higher than that of the preceding godet roller.

The general description of the present invention as described above is only for illustrating or describing the present invention, and does not limit the scope of the present invention.

Advantageous Effects

Although the polyethylene multifilament interlaced yarn of the present disclosure is manufactured by melt spinning, it has high tenacity, thereby enabling the manufacture of a protective product having excellent cutting resistance.

Further, according to the present disclosure, sufficient entanglement may be provided to the polyethylene multifilament yarn, so that cohesion strength between the filaments may be improved. Accordingly, it is possible to prevent or minimize a fluffing problem that occurs when some filament(s) are cut due to friction in the process of weaving the fabric of the protective product and/or in the process of doubling with other types of yarn. When manufacturing a protective product using such a polyethylene yarn having high weavability, it is possible to improve the quality of the final product and increase its productivity.

BRIEF DESCRIPTION OF THE DRAWINGS

The accompanying drawings are intended to aid understanding of the present invention and constitute a part of the present disclosure, illustrate embodiments of the present invention, and describe the principles of the present invention together with the detailed description of the present invention.

FIG. 1 schematically shows an apparatus for manufacturing a polyethylene multifilament interlaced yarn according to an embodiment of the present disclosure.

DETAILED DESCRIPTION OF THE EMBODIMENTS

Hereinafter, the polyethylene multifilament interlaced yarn and the method of manufacturing the same according to the exemplary embodiments of the present disclosure will be described in more detail.

The terms are used merely to refer to specific embodiments, and are not intended to restrict the present disclosure unless it is explicitly expressed.

Singular expressions of the present disclosure may include plural expressions unless they are differently expressed contextually.

The terms 'include', 'comprise', and the like of the present disclosure are used to specify certain features, regions, integers, steps, operations, elements, and/or components, and these do not exclude the existence or the addition of other certain features, regions, integers, steps, operations, elements, and/or components.

According to an embodiment of the present disclosure, there may be provided a polyethylene multifilament interlaced yarn including filaments having a weight average molecular weight of 90,000 to 300,000 g/mol, a tenacity of 12 to 20 g/d, and a degree of entanglement of 10 nodes/m or more.

The present disclosure relates to a polyethylene multifilament interlaced yarn for a protective product capable of optimizing the degree of entanglement and imparting excellent tenacity during the manufacture of filament yarns in order to prevent the reduction in cohesion strength due to the occurrence of fluff and improve weavability of the existing filament yarn, and a method of manufacturing the same.

According to the method of the present disclosure, the frequency of occurrence of fluff during the drawing and doubling processes is significantly reduced compared to the prior art, so that it is possible to provide a polyethylene multifilament interlaced yarn for fabric of a protective product having high cut resistance and excellent fit. Therefore, in the present disclosure, it is possible to reduce productivity and production cost by improving weavability of the yarn.

Specifically, the polyethylene multifilament interlaced yarn of the present disclosure may include a certain number of filament bundles, and these are interlaced with a degree of entanglement of 10 nodes/m or more in order to impart cohesion strength to the filaments. At this time, the degree of entanglement may be measured while rereeling the polyethylene multifilament interlaced yarn using Lenzing's RAPID-500 according to ASTM D4724 (2011) (Standard Test Method for Entanglements in Unwinded Filament Yarns by Needle Insertion).

That is, the polyethylene multifilament interlaced yarn may have a degree of entanglement of 10 nodes/m or more, more preferably 20 to 40 nodes/m, and even more preferably 30 to 40 nodes/m.

As described above, since filaments formed of polyethylene not only have a smooth surface, but also have electrostatic surface properties that cause repulsion between the filaments, less than 10 nodes/m of the degree entanglement lacks cohesion strength between the filaments. Therefore, in the process of weaving the fabric of the protective product and/or in the process of doubling with other types of yarn, some filament(s) are cut due to friction, generating fluff. The occurrence of such fluff not only causes a decrease in productivity of the fabric and an increase in production cost, but also causes a decrease in quality of the protective product.

On the other hand, in order to form a multifilament interlaced yarn with a degree of entanglement exceeding 40 nodes/m, excessively high-pressure air should be applied to the multifilament yarn during the interlacing process. In this process, there is a high risk of cutting the filament(s) and causing fluff.

In addition, the polyethylene multifilament interlaced yarn of the present disclosure, which is used in the manufacture of products requiring high cutting resistance and/or high tenacity such as protective products and produced by melt spinning according to an embodiment of the present disclosure, has a weight average molecular weight (Mw) of 90,000 to 300,000 g/mol. Preferably, the polyethylene multifilament interlaced yarn may have a weight average molecular weight (Mw) of 90,000 to 250,000 g/mol.

In the present disclosure, the weight average molecular weight (Mw) refers to a weight average molecular weight measured by a GPC method and calibrated with polystyrene. In the process of measuring the weight average molecular weight calibrated with polystyrene by a GPC method, a known analyzer, a detector such as a refractive index detector, and an analyzing column may be used. Conventional temperature conditions, solvents, and flow rates can be applied. For example, it may be performed at a temperature of 160° C. using a trichlorobenzene (TCB) solvent at a flow rate of 1 mL/min.

In addition, it is desirable that the polyethylene multifilament interlaced yarn satisfies all the physical properties of 12 to 20 g/d of a tenacity, 100 to 300 g/d of an initial modulus, 6 to 10% of an elongation, and more than 5 and 9 or less of a polydispersity index (PDI) in order to improve the quality of the protective product, while satisfying 10 nodes/m or more of the degree of entanglement.

As a preferred example, the tenacity of the polyethylene multifilament interlaced yarn may be 13 to 20 g/d, and the elongation may be 7 to 10%.

In addition, the polyethylene multifilament interlaced yarn preferably has the initial modulus of 100 to 250 g/d, and most preferably 120 to 240 g/d or 150 to 235 g/d.

In addition, if the tenacity exceeds 20 g/d, the initial modulus exceeds 300 g/d, or the elongation is less than 6%, damages to a weaving machine may occur during the manufacture of fabric using the polyethylene multifilament interlaced yarn. In addition, the produced fabric is too stiff, which makes wearers of the protective product feel uncomfortable. Particularly, if the initial modulus exceeds 300 g/d or the elongation is less than 6%, it is difficult to transform the shape of the filaments, making it difficult to impart a degree of entanglement of 10 nodes/m or more to the multifilament yarn.

Conversely, if the tenacity is less than 12 g/d, the initial modulus is less than 100 g/d, or the elongation exceeds 10%, continuous use of the fabric made of such polyethylene multifilament interlaced yarn causes pills on the fabric, and even breakages of fabric.

However, if the polyethylene multifilament interlaced yarn satisfies the above tenacity and initial modulus, but not the degree of entanglement of 10 nodes/m or more, some filament(s) are cut due to friction in the process of weaving the fabric of yarn and/or in the process of doubling with other types of yarn, generating fluff. In addition, physical properties such as tenacity and the degree of entanglement of the polyethylene multifilament interlaced yarn may be in a preferred range by adjusting the configuration of the drawing step and the interlacing step according to the following description.

The polyethylene multifilament interlaced yarn of the present disclosure includes 40 to 500 filaments. Each filament has a fineness of 1 to 3 denier, and the polyethylene multifilament interlaced yarn has a total fineness of 100 to 1,000 denier.

As described above, if physical properties of the polyethylene multifilament interlaced yarn do not satisfy all of the above configurations, the frequency of occurrence of fluff increases during a doubling process using a filament interlaced yarn, thereby reducing processability in the manufacture of fabric. In addition, the appearance of the fabric product is not good, and when used, pills are easily induced, making it difficult to obtain a product having a desired shape.

In particular, when the polyethylene multifilament interlaced yarn satisfies the initial modulus and the degree of entanglement at the same time within the above-described range, it is possible to improve the fit of the product fabric by reducing the frequency of occurrence of fluff during drawing.

According to another embodiment of the present disclosure, there may be provided a method of manufacturing the polyethylene multifilament interlaced yarn, including the steps of: obtaining a polyethylene melt by melting polyethylene chips having a polydispersity index (PDI) of more than 5 and 9 or less and a melt index (MI at 190° C.) of 0.3 to 3 g/10 min; extruding the polyethylene melt through a spinneret having a plurality of nozzle holes; quenching a plurality of filaments formed when the polyethylene melt is discharged from the nozzle holes; forming a multifilament yarn by collecting the plurality of quenched filaments; drawing the multifilament yarn at a total draw ratio of 11 to 23 times, followed by heat setting; interlacing the drawn multifilament yarn; and winding the interlaced multifilament yarn.

In the present disclosure, when using polyethylene chips having a polydispersity index and a melt index within specific ranges, the total draw ratio is specifically adjusted to 11 to 23 times in the drawing step. In addition, in the present disclosure, adjusting the number of stages in the drawing step and the air pressure in the interlacing step can give 10 nodes/m or more of the degree of entanglement of the polyethylene multifilament interlaced yarn. Accordingly, the present disclosure can give the degree of entanglement that can reduce the occurrence of fluff and improve weavability and productivity of the fabric. Further, the present disclosure is characterized in that it satisfies the ranges of tenacity, initial modulus, and elongation capable of preventing shape deformation and damage to the weaving machine when weaving yarns using filaments while providing the characteristics of the degree of entanglement.

Hereinafter, a method of manufacturing a polyethylene multifilament interlaced yarn according to an embodiment of the present disclosure will be described in detail with reference to FIG. 1.

First, a polyethylene melt is obtained by injecting polyethylene in the form of chips into an extruder (100) for melting.

The polyethylene (hereinafter, referred to as 'polyethylene chips') used as a raw material in the method of the present disclosure has a melt index (MI) of 0.3 to 3 g/10 min. In the present disclosure, the melt index of the polyethylene chips is measured at 190° c.

If the melt index (MI) of the polyethylene chips is less than 0.3 g/10 min, it is difficult to ensure appropriate flowability in the extruder (100) due to high viscosity and low flowability of the polyethylene melt, which causes an overload on a spinning device. Accordingly, process control cannot be properly performed, and it is difficult to ensure uniformity of yarn properties. On the other hand, if the melt index (MI) of the polyethylene chips exceeds 3 g/10 min, the flowability of the polyethylene melt in the extruder (100) is relatively good, but it is difficult to obtain a yarn having a high tenacity of 12 g/d or more due to the low molecular weight of polyethylene.

The polyethylene chips may have a weight average molecular weight (Mw) of 90,000 g/mol or more. If the weight average molecular weight (Mw) is less than 90,000 g/mol, it is difficult for the finally obtained yarn to have a tenacity of 12 g/d or more.

On the other hand, if the weight average molecular weight (Mw), which is generally inversely proportional to the melt index (MI), is too large, an overload is applied to the spinning device due to the high melt viscosity and process control is not properly performed, making it difficult to ensure excellent physical properties of the yarn. Therefore, the upper limit of the weight average molecular weight (Mw) of the polyethylene chips is preferably 320,000, which is slightly higher than the upper limit of the target molecular weight (i.e., weight average molecular weight of polyethylene yarn, which is 90,000 to 300,000 g/mol in the present disclosure), because thermal decomposition of polyethylene in the spinning process may cause some decrease in molecular weight.

The polyethylene chips of the present disclosure have a polydispersity index (PDI) of more than 5 and 9 or less. The polydispersity index (PDI) is a ratio (Mw/Mn) of the weight average molecular weight (Mw) to the number average molecular weight (Mn), and is also referred to as molecular weight distribution index (MWD).

Almost all prior arts disclosing high-tenacity polyethylene yarns manufactured by melt spinning high-density polyethylene (HDPE) [for example, Korean Patent No. 10-0943592 (hereinafter, referred to as 'prior art 1'), Korean Patent Publication No. 10-2014-0075842 (hereinafter, referred to as 'prior art 2'), etc.] disclosed that the polyethylene should have a polydispersity index (PDI) of 4.0 or less (prior art 1: see 'Abstract'), or even 2.5 or less (prior art 2: See paragraphs [0034] & [0035]) in order for the polyethylene yarn to have high tenacity.

However, when a yarn is manufactured using polyethylene chips having a low polydispersity index (PDI) as disclosed in the prior arts, although it is easy to achieve high tenacity, but it is impossible to impart sufficient entanglements to the yarn due to excessively high initial modulus [e.g., the polyethylene yarn of prior art 1 has an initial modulus of 500 cN/dtex (=about 567 g/d) or more] and excessively low elongation.

If the initial modulus exceeds 300 g/d or the elongation is less than 6%, it is very difficult to change the shape of the filaments and make them entangled even when high-pressure air is sprayed to impart entanglements. And even if the filaments are instantaneously entangled, the entanglements are weak and quickly released, making it difficult to impart a degree of entanglement of 10 nodes/m or more to the polyethylene yarn. In particular, when the air pressure is excessively increased in order to forcibly impart entanglements, pills or a breakage of filaments may occur.

According to the present disclosure, it has been found that an initial modulus and an elongation of a polyethylene yarn are mainly influenced by a polydispersity index (PDI) of polyethylene chips used as a raw material. In addition, it has been found that in order for the polyethylene yarn to have an initial modulus of 300 g/d or less and an elongation of 6% or more, the polyethylene chips should have a polydispersity index (PDI) of more than 5.

However, if the polydispersity index (PDI) of the polyethylene chips is too high (i.e., if too much low molecular weight polyethylene is included), it is difficult to manufacture a polyethylene yarn having a high tenacity of 12 g/d or more. Therefore, the upper limit of the polydispersity index (PDI) of the polyethylene chips is preferably 9, which is slightly higher than the upper limit of the target polydispersity index (i.e., polydispersity index of polyethylene yarn, which is more than 5 and 8 or less in the present disclosure), in consideration of the fact that the polydispersity index may decrease during the spinning process.

Optionally, in order to prevent a breakage of filaments in the spinning process and the drawing process, a fluorine-based polymer may be added to the polyethylene melt. The method of adding the fluorine-based polymer may include (i) a method of injecting a master batch containing polyethylene and a fluorine-based polymer into an extruder (100) together with polyethylene chips, and then melting them together, (ii) a method of injecting a fluorine-based polymer into an extruder (100) through a side feeder while injecting polyethylene chips into the extruder (100), and then melting them together, and the like.

The fluorine-based polymer added to the polyethylene melt may be, for example, a tetrafluoroethylene copolymer. The fluorine-based polymer may be added to the polyethylene melt in an amount such that 50 to 2500 ppm of fluorine is contained in the yarn to be finally manufactured.

The polyethylene melt is transferred to a spinneret (200) having a plurality of nozzle holes by a screw in the extruder (100), and then extruded through the nozzle holes. The number of nozzle holes of the spinneret (200) may be determined according to DPF (Denier Per Filament) and a total fineness of the yarn to be manufactured. According to an embodiment of the present disclosure, in order to manufacture a yarn having 1 to 3 of DPF and 100 to 1,000 denier of a total fineness, the spinneret (200) may have 40 to 500 nozzle holes.

The melting process in the extruder (100) and the extrusion process through the spinneret (200) are performed at 150 to 315° C., preferably 250 to 315° C., more preferably 280 to 310° C. That is, it is preferable that the extruder (100)

and the spinneret (200) are maintained at 150 to 315° C., preferably 250 to 315° C., more preferably 280 to 310° C. According to an embodiment of the present disclosure, a space in which the polyethylene chips move from input into the extruder (100) until discharge through nozzle holes of the spinneret (200) is divided into a plurality of spaces, and the temperature is controlled for each divided space. For example, within the temperature range of 150 to 315° C., preferably 250 to 315° C., more preferably 280 to 310° C., the temperature of each divided space may be controlled so that the temperature of the divided space at the rear end is equal to or higher than the temperature of the divided space at the front end.

If the spinning temperature is less than 150° C., the polyethylene chips are not uniformly melted, and thus spinning may be difficult. On the other hand, if the spinning temperature exceeds 315° C., thermal decomposition of polyethylene may be caused, and thus it may be difficult to achieve high tenacity.

L/D, which is a ratio of the hole length (L) to the hole diameter (D) in the spinneret (200), may be 3 to 40. If the L/D is less than 3, die swell occurs during melt extrusion and it is difficult to control the elastic behavior of polyethylene, resulting in poor spinnability. If the L/D exceeds 40, uneven discharge due to pressure drop may occur along with a breakage of filaments due to necking of the polyethylene melt passing through the spinneret (200).

As the polyethylene melt is discharged from the nozzle holes of the spinneret (200), the polyethylene melt starts to solidify due to a difference between the spinning temperature and room temperature, thereby forming a plurality of semi-solidified filaments (11). In this disclosure, both the semi-solidified filament and the fully-solidified filament are collectively referred to as "filament".

The plurality of filaments (11) are completely solidified by quenching in a quenching zone (300). The quenching of the filaments (11) may be performed by air quenching. For example, the quenching of the filaments (11) may be performed at 15 to 40° C. using cooling air of 0.2 to 1.0 m/sec. If the quenching temperature is less than 15° C., the elongation may be insufficient due to supercooling, and thus a breakage of filaments may occur in the subsequent drawing process. If the quenching temperature exceeds 40° C., a deviation of fineness between the filaments (11) increases due to uneven solidification, and a breakage of filaments may occur in the drawing process.

Subsequently, the quenched and completely solidified filaments (11) are collected by a collecting zone (400) to form one multifilament yarn (10).

As illustrated in FIG. 1, an oiling process of applying an oil agent to the filaments (11) using an oil roller (OR) or an oil jet may be further performed, before forming the multifilament yarn (10). The application of the oil agent may be performed in a MO (Metered Oiling) method.

Optionally, when collecting the filaments (11) to form the multifilament yarn (10), the oiling process may be performed at the same time. Alternatively, an additional oiling process may be further performed during a drawing process and/or immediately before a winding process.

Subsequently, the multifilament yarn (10) is drawn at a total draw ratio of 11 to 23 times, more preferably 14 to 20 times.

If the total draw ratio is 11 times or less, it may be difficult to improve the degree of entanglement of the polyethylene multifilament interlaced yarn. That is, in order for the final polyethylene multifilament interlaced yarn to have a tenacity of 12 g/d or more, more preferably 13 g/d or more despite the use of polyethylene chips having a polydispersity index (PDI) exceeding 5, the multifilament yarn (10) should be drawn at a total draw ratio of 11 times or more. However, if the draw ratio is too low, the final polyethylene filament interlaced yarn may have a tenacity of 12 g/d or more, but the initial modulus exceeds 300 g/d. Therefore, it is very difficult to change the shape of the filaments and make them entangled even when high-pressure air is sprayed to impart entanglements. And even if the filaments are instantaneously entangled, the entanglements are weak and quickly released, resulting in an increase in frequency of occurrence of fluff. In addition, if a total draw ratio exceeds 23 times, the risk of occurrence of a breakage of filament(s) (11) increases.

As illustrated in FIG. 1, the polyethylene multifilament interlaced yarn of the present disclosure can be manufactured through a direct spinning (DSD) process in which the multifilament yarn (10) is not wound and is directly transferred to a drawing zone (500) to be drawn.

Alternatively, the multifilament yarn (10) may be wound once as an undrawn yarn, and then the undrawn yarn may be rereeled and drawn. That is, the polyethylene multifilament interlaced yarn of the present disclosure may be manufactured through a two-step process of first preparing an undrawn yarn, and then drawing the undrawn yarn.

In particular, regardless of whether the direct spinning (DSD) process or the two-step process is applied, the drawing process needs to be precisely controlled in order to minimize the risk of a breakage of filament(s) (11) when the multifilament yarn (10) is drawn at a high total draw ratio of 11 times to 23 times.

According to an embodiment of the present disclosure, for a precise control of the drawing process, the multifilament yarn (10) may be multi-stage drawn by a multi-stage drawing zone (500) including a plurality of godet rollers (GR1 . . . GRn). That is, the multifilament yarn (10) may be multi-stage drawn by a sufficient number of godet rollers (GR1 . . . GRn) enabling a precise control of the drawing condition.

According to an embodiment, the drawing step using the plurality of godet rollers is preferably performed in multi-stage drawing of 4 stages or more. Most preferably, the drawing step may be performed in multi-stage drawing of 4 stages or more and 20 stages or less using a plurality of godet rollers. If the multi-stage drawing is performed with 4 stages or less, rapid drawing occurs in each section (GR1 and GR2 . . . GRn−1 and GRn) of the godet rollers, resulting in an increase in frequency of occurrence of fluff and an increase in initial modulus during the manufacture of the filament yarn, and thus the fabric can become too stiff. In addition, if the multi-stage drawing is performed with 20 stages or more, there is a problem that friction between the filament yarn and the godet roller increases, resulting in damage and breakage of filaments.

In addition, even if the polyethylene chips having a polydispersity index (PDI) of more than 5 and 9 or less and a melt index (MI) of 0.3 to 3 g/10 min (at 190° C.) are used, the degree of entanglement may be lowered when the high total draw ratio of 11 times to 23 times or the number of stages is not satisfied according to the method of the present disclosure. That is, even if the polyethylene multifilament interlaced yarn exhibits a certain level of tenacity, initial modulus, and elongation, the degree of entanglement is as low as 10 nodes/m or less. Accordingly, there is problem that the frequency of occurrence of fluff increases during drawing, making a doubling process difficult. Therefore, it can be seen that when drawing with a high total draw ratio of 11 times to 23 times, the number of stages should be adjusted for precise control to minimize the risk of a breakage of filaments.

According to an embodiment of the present disclosure, multi-stage drawing and heat-setting of the multifilament yarn (10) may be performed at the same time with the godet rollers (GR1 . . . GRn) by appropriately setting the temperature of the godet rollers (GR1 . . . GRn) of the drawing zone (500) in the range of 40 to 140° C., more preferably 60 to 130° C., even more preferably 70 to 120° C.

For example, the temperature of the first godet roller (GR1) among the plurality of godet rollers (GR1 . . . GRn) may be 40 to 80° C., and the temperature of the last godet roller (GRn) may be 110 to 140° C. The temperature of each godet roller other than the first and last godet rollers (GR1, GRn) may be set at a temperature equal to or higher than that of the preceding godet roller. The temperature of the last godet roller (GRn) may be set at a temperature equal to or higher than that of the preceding godet roller, but may be also set at a temperature slightly lower than that.

Subsequently, the multifilament yarn (10) drawn at a total draw ratio of 11 to 23 times is interlaced by an interlacing device (600), and then wound around a winder (700).

As described above, since the multifilament yarn (10) spun and drawn according to the present disclosure has a relatively low initial modulus of 300 g/d or less and a relatively high elongation of 6% or more, it is possible to impart a degree of entanglement of 10 nodes/m or more, preferably 20 to 40 nodes/m, more preferably 30 to 40 nodes/m through the interlacing process.

The air pressure applied to the multifilament yarn (10) during the interlacing process may be 15 to 100 psi. Preferably, the air pressure may be 30 to 80 psi or 50 to 70 psi.

If the air pressure is less than 15 psi, it is difficult to impart a degree of entanglement of 10 nodes/m or more. On the other hand, if an excessively high air pressure exceeding 100 psi is applied to the multifilament yarn (10), there is a high risk of a breakage of filament(s) and causing fluff.

Assuming that the air pressure applied to the multifilament yarn (10) during the interlacing process is the same, the degree of entanglement may be further adjusted by relax and/or tension applied to the multifilament yarn (10).

According to an embodiment of the present disclosure, in order to impart a degree of entanglement of 10 nodes/m or more, more preferably 20 to 40 nodes/m, and most preferably 30 to 40 nodes/m, 0 to 10% of a relax is applied to the drawn multifilament yarn (10). The relax is calculated by the following Equation 1.

$$R(\%)=[(V_{max}-V_w)/V_{max}]\times 100 \quad \text{[Equation 1]}$$

In Equation 1, R is a relax (%), $V_{max}$ is the highest linear velocity among linear velocities of godet rollers (mpm), and $V_w$ is a winding velocity (mpm).

In addition, according to an embodiment of the present disclosure, a tension of 0.1 to 0.5 g/d is applied to the multifilament yarn (10) during the interlacing step and the winding step.

A higher degree of entanglement can be imparted to the multifilament yarn (10) by applying 0% or more of a relax and 0.5 g/d or less a tension to the multifilament yarn (10). However, a relax of more than 10% or a tension of less than 0.1 g/d deteriorates productivity of the polyethylene multifilament interlaced yarn.

The high-tenacity polyethylene multifilament interlaced yarn of the present disclosure prepared as above can be used not only in the manufacture of protective products, but also in the manufacture of other applications requiring excellent cut resistance and/or high tenacity such as ropes, fishing lines, fishing nets, tents, tent materials, sports goods, etc., as well as living materials such as bedding and clothing used in everyday life.

Hereinafter, the present invention will be described in detail with specific examples. However, the following examples are only for helping the understanding of the present invention, and the scope of the present invention should not be limited by them.

Example 1

A polyethylene multifilament interlaced yarn including 200 filaments was manufactured using the apparatus illustrated in FIG. 1, wherein the polyethylene multifilament interlaced yarn has a total fineness of 400 denier.

Specifically, polyethylene chips having a weight average molecular weight (Mw) of 200,000 g/mol, a melt index (MI @190° C.) of 1 g/10 min, and a polydispersity index (Mw/Mn: PDI) of 7.5 were added to an extruder (100), and melted. The polyethylene melt was extruded through a spinneret (200) having 200 nozzle holes.

The filaments (11) formed while being discharged from the nozzle holes of the spinneret (200) were quenched in a quenching zone (300), and then collected by a collecting zone (400) into a multifilament yarn (10).

Subsequently, the multifilament yarn was drawn at a total draw ratio of 16 times by a plurality of godet rollers set at 70 to 115° C. (the godet roller in rear stage was set at a temperature higher than that of the godet roller in preceding stage) in a drawing unit (500), followed by heat-setting.

Specifically, the drawing step was performed in 7 stages using 7 godet rollers.

Subsequently, the drawn multifilament yarn was interlaced with an air pressure of 60 psi in an interlacing device (600), and then wound around a winder (700). The winding tension was 0.5 g/d.

Example 2

A polyethylene multifilament interlaced yarn was prepared in the same manner as in Example 1, except that 1% of a relax represented by the following Equation 1 was applied to the drawn multifilament yarn.

$$R(\%)=[(V_{max}-V_w)/V_{max}]\times 100 \quad \text{[Equation 1]}$$

In Equation 1, R is a relax, $V_{max}$ is the highest linear velocity among linear velocities of godet rollers, and $V_w$ is a winding velocity.

Example 3

A polyethylene multifilament interlaced yarn was prepared in the same manner as in Example 1, except that the winding tension was 0.16 g/d.

Example 4

A polyethylene multifilament interlaced yarn was prepared in the same manner as in Example 3, except that 3% of a relax was applied to the drawn multifilament yarn.

Example 5

A polyethylene multifilament interlaced yarn was prepared in the same manner as in Example 1, except that polyethylene chips having a weight average molecular weight (Mw) of 170,000 g/mol, a melt index (MI @190° C.) of 1 g/10 min, and a polydispersity index (Mw/Mn: PDI) of 7.5 were used and the winding tension was 0.35 g/d.

Example 6

A polyethylene multifilament interlaced yarn was prepared in the same manner as in Example 1, except that the drawing step was performed in 5 stages using 5 godet rollers at a total draw ratio of 11 times, followed by heat-setting, and the winding tension was 0.35 g/d.

Example 7

A polyethylene multifilament interlaced yarn was prepared in the same manner as in Example 1, except that the drawing step was performed in 14 stages using 14 godet rollers at a total draw ratio of 23 times, followed by heat-setting, and the winding tension was 0.35 g/d.

Comparative Example 1

A polyethylene multifilament interlaced yarn was prepared in the same manner as in Example 1, except that polyethylene chips having a weight average molecular weight (Mw) of 200,000 g/mol, a melt index (MI @190° C.) of 1 g/10 min, and a polydispersity index (Mw/Mn: PDI) of 4.5 were used.

Comparative Example 2

A polyethylene multifilament interlaced yarn was prepared in the same manner as in Comparative Example 1, except that 3% of a relax was applied to the drawn multifilament yarn, and the winding tension was 0.35 g/d.

Comparative Example 3

A polyethylene multifilament interlaced yarn was prepared in the same manner as in Example 2, except that the drawing step was performed in 2 stages using 2 godet rollers at a total draw ratio of 6 times, followed by heat-setting, and the winding tension was 0.35 g/d.

Comparative Example 4

A polyethylene multifilament interlaced yarn was prepared in the same manner as in Example 2, except that the drawing step was performed in 3 stages using 3 godet rollers at a total draw ratio of 8 times, followed by heat-setting, and the winding tension was 0.35 g/d.

Comparative Example 5

A polyethylene multifilament interlaced yarn was prepared in the same manner as in Example 2, except that the drawing step was performed in 3 stages using 3 godet rollers at a total draw ratio of 16 times, followed by heat-setting, and the winding tension was 0.35 g/d.

Comparative Example 6

A polyethylene multifilament interlaced yarn was prepared in the same manner as in Example 2, except that the drawing step was performed in 14 stages using 14 godet rollers at a total draw ratio of 25 times, followed by heat-setting, and the winding tension was 0.35 g/d.

Comparative Example 7

A polyethylene multifilament interlaced yarn was prepared in the same manner as in Example 2, except that the interlacing process was performed under the air pressure of 150 psi.

Comparative Example 8

A polyethylene multifilament interlaced yarn was prepared in the same manner as in Example 2, except that the interlacing process was performed under the air pressure of 10 psi.

Experimental Examples

The tenacity, initial modulus, elongation, weight average molecular weight (Mw), polydispersity index (Mw/Mn: PDI), and degree of entanglement of the polyethylene multifilament interlaced yarns prepared in Examples and Comparative Examples were measured by the following methods, and the results are shown in Tables 1 and 2 below.

Tenacity (q/d), Initial Modulus (q/d), Elongation (%)

A strain-stress curve of a polyethylene multifilament interlaced yarn was obtained using a universal tensile tester manufactured by Instron Engineering Corp (Canton, Mass) in accordance with ASTM D885. The sample was 250 mm long, a tensile velocity was 300 mm/min, and an initial load was set to 0.05 g/d. The tenacity (g/d) and elongation (%) were obtained from the stress and elongation at the breaking point, and the initial modulus (g/d) was obtained from the tangent line giving the maximum gradient near the origin of the curve. After measuring five times for each interlaced yarn, the average value was calculated.

Weight Average Molecular Weight (Mw, q/Mol), Polydispersity Index (PDI)

After completely dissolving a polyethylene multifilament interlaced yarn in the following solvent, a weight average molecular weight (Mw), a number average molecular weight (Mn), and a polydispersity index (Mw/Mn: PDI) were measured by the following gel permeation chromatography (GPC).

Analyzer: PL-GPC 220 system
Column: 2×PLGEL MIXED-B (7.5×300 mm)
Column temperature: 160° C.
Solvent: Trichlorobenzene (TCB)+0.04 wt % dibutylhydroxytoluene (BHT, after drying with 0.1% $CaCl_2$))
Dissolution conditions: 160° C., 1~4 hours, measuring the solution passed through a glass filter (0.7 μm) after dissolution
Temperature of injector, detector: 160° C.
Detector: RI Detector
Flow rate: 1.0 ml/min
Injection volume: 200 μl
Standard sample: Polystyrene Degree of Entanglements (Nodes/m)

The degree of entanglement was measured while rereeling the polyethylene multifilament interlaced yarn using Lenzing's RAPID-500 according to ASTM D4724 (2011) (Standard Test Method for Entanglements in Unwinded Filament Yarns by Needle Insertion). When the fineness of the interlaced yarn to be measured (here, 400 denier) is input to the device, the degree of entanglement of the interlaced yarn is measured while a predetermined load corresponding to the fineness (here, about 29 g) is applied to the interlaced yarn.

TABLE 1

| | Examples | | | | | | |
|---|---|---|---|---|---|---|---|
| | 1 | 2 | 3 | 4 | 5 | 6 | 7 |
| PE chip Mw(g/mol) | 200,000 | 200,000 | 200,000 | 200,000 | 170,000 | 200,000 | 200,000 |
| MI (g/10 min) | 1 | 1 | 1 | 1 | 1 | 1 | 1 |
| PDI | 7.5 | 7.5 | 7.5 | 7.5 | 7.5 | 7.5 | 7.5 |
| Type of drawing | 7-stage drawing | 7-stage drawing | 7-stage drawing | 7-stage drawing | 7-stage drawing | 5-stage drawing | 14-stage drawing |
| Total draw ratio | 16 times | 16 times | 16 times | 16 times | 16 times | 11 times | 23 times |
| Relax (%) | — | 1 | — | 3 | — | — | — |
| Air pressure during interlacing | 60 | 60 | 60 | 60 | 60 | 60 | 60 |
| Winding tension (g/d) | 0.5 | 0.5 | 0.16 | 0.16 | 0.35 | 0.35 | 0.35 |
| Physical properties of polyethylene multifilament interlaced yarn | | | | | | | |
| Tenacity (g/d) | 14 | 13.6 | 14.1 | 13.7 | 13.5 | 12.5 | 16.3 |
| Degree of entanglements (nodes/m) | 10 | 12 | 23 | 33 | 16 | 21 | 12 |
| Initial modulus (g/d) | 200 | 185 | 200 | 180 | 175 | 162 | 231 |
| Elongation (%) | 8 | 8.1 | 8 | 8.2 | 8 | 9.6 | 7.2 |
| Mw (g/mol) | 180,000 | 180,000 | 180,000 | 180,000 | 160,000 | 180,000 | 180,000 |
| PDI | 5.6 | 5.6 | 5.6 | 5.6 | 6.5 | 5.6 | 5.6 |
| Frequency of fluff occurrence during drawing | 3 | 2 | 2 | 3 | 2 | 5 | 3 |
| Frequency of fluff occurrence during doubling | 5 | 4 | 2 | 2 | 3 | 6 | 7 |

TABLE 2

| | Comparative Examples | | | | | | | |
|---|---|---|---|---|---|---|---|---|
| | 1 | 2 | 3 | 4 | 5 | 6 | 7 | 8 |
| PE chip Mw(g/mol) | 200,000 | 200,000 | 200,000 | 200,000 | 200,000 | 200,000 | 200,000 | 200,000 |
| MI (g/10 min) | 1 | 1 | 1 | 1 | 1 | 1 | 1 | 1 |
| PDI | 4.5 | 4.5 | 7.5 | 7.5 | 7.5 | 7.5 | 7.5 | 7.5 |
| Type of drawing | 7-stage drawing | 7-stage drawing | 2-stage drawing | 3-stage drawing | 3-stage drawing | 14-stage drawing | 7-stage drawing | 7-stage drawing |
| Total draw ratio | 16 times | 16 times | 6 times | 8 times | 16 times | 25 times | 16 times | 16 times |
| Relax (%) | — | 3 | 1 | 1 | 1 | 1 | 1 | 1 |
| Air pressure during interlacing | 60 | 60 | 60 | 60 | 60 | 60 | 150 | 10 |
| Winding tension (g/d) | 0.5 | 0.35 | 0.35 | 0.35 | 0.35 | 0.35 | 0.35 | 0.35 |
| Physical properties of polyethylene multifilament interlaced yarn | | | | | | | | |
| Tenacity (g/d) | 16 | 15.6 | 13.7 | 14.4 | Unable to produce yarn due to breakage during drawing | Unable to produce yarn due to breakage during drawing | 13.5 | 13.6 |
| Degree of entanglements (nodes/m) | 5 | 8 | 7 | 6 | | | 6 | 3 |
| Initial modulus (g/d) | 360 | 352 | 311 | 325 | | | 183 | 185 |
| Elongation (%) | 7 | 7.2 | 7.9 | 7.6 | | | 8.1 | 8.1 |
| Mw (g/mol) | 180,000 | 180,000 | 180,000 | 180,000 | | | 180,000 | 180,000 |
| PDI | 3 | 3 | 5.6 | 5.6 | | | 5.6 | 5.6 |
| Frequency of fluff occurrence during drawing | 2 | 2 | 5 | 4 | | | 5 | 3 |
| Frequency of fluff occurrence during doubling | 3 | 3 | 15 | 19 | | | 13 | 8 |

Referring to Tables 1 and 2, it can be seen that Examples 1 to 7 in which the total draw ratio is adjusted within the range of 11 times to 23 times, and multi-stage drawing using godet rollers is adjusted to 4 stages or more and 20 stages or less exhibited a degree of entanglement of 10 nodes/m or more while having excellent tenacity compared to Comparative Examples, so that a polyethylene multifilament interlaced yarn capable of reducing the occurrence of fluff during drawing could be provided. In addition, Examples were able to provide an interlaced yarn capable of reducing the occurrence of fluff, as the air pressure during interlacing was also adjusted within a specific range. In addition, in the case of Examples in which the multifilament interlaced yarns were manufactured using polyethylene chips having PDI of 7.5, it can be seen that not only the interlaced yarns of Example 2 to which 1% of a relax was applied and Example 4 to which 3% of a relax was applied, but also the interlaced yarns of Examples 1, 3, and 4 to which no relax was applied had a high degree of entanglement of 10 nodes/m or more.

On the other hand, in the case of Comparative Examples in which the multifilament interlaced yarns were manufactured using polyethylene chips having PDI of 4.5, it can be seen that Comparative Example 2 to which 3% of a relax and 0.35 g/d of a winding tension were applied also had a low degree of entanglement of less than 10 nodes/m like Comparative Example 1. In addition, in the case of Comparative Examples 1 and 2, although the occurrence of fluff during drawing was not frequent, the initial modulus was high along with a low degree of entanglement, resulting in a problem in that weavability was deteriorated and the fabric became stiff.

In addition, since Comparative Examples 3 and 4 performed the drawing process with 3 stages or less at a draw ratio of 6 times and 8 times, sufficient entanglement could not be provided even though they had a tenacity similar to that of the present disclosure, so the initial modulus was also high and fluff was severely generated during the doubling process, causing product defects in fabric. In Comparative Examples 5 to 6, the type of drawing and the total draw ratio were out of the scope of the present disclosure, and thus it was impossible to produce a yarn due to a breakage of filaments. Comparative Examples 7 to 8 exhibited a low degree of entanglement of 6 nodes/m or less due to the too high or too low air pressure in the interlacing process, and as a result, not only the frequency of occurrence of fluff during drawing, but also the occurrence of fluff during doubling increased.

| [DESCRIPTION OF SYMBOLS] | | |
|---|---|---|
| 100: Extruder | 200: Spinneret | 300: Quenching zone |
| 400: Collecting zone | 500: Drawing zone | 600: Interlacing device |
| 700: Winder | | |

The invention claimed is:

1. A polyethylene multifilament interlaced yarn comprising filaments having a weight average molecular weight of 90,000 to 300,000 g/mol, and a polydispersity index (PDI) of more than 5 and 9 or less, wherein the polyethylene multifilament interlaced yarn simultaneously satisfies a tenacity of 12 to 20 g/d, a degree of entanglement of 10 to 40 nodes/m, an initial modulus of 100 to 300 g/d, and an elongation of 6 to 10%, wherein the polyethylene multifilament interlaced yarn comprises filaments drawn from a multifilament yarn formed from polyethylene chips, wherein the multifilament yarn is drawn at a total draw ratio in the range of 11 to 23 times and performing multi-stage drawing of 4 stages or more and 20 stages or less using a plurality of godet rollers, wherein the weight average molecular weight of the yarn is measured by the GPC method and calibrated with polystyrene in 1,2,4-trichlorobenzene containing 0.04 wt % butylated hydroxytoluene at 160° C., and wherein the degree of entanglement is measured while a predetermined load corresponding to the fineness (29 g for 400 denier yarn) is applied to the interlaced yarn according to ASTM D4724 (2011).

2. The polyethylene multifilament interlaced yarn of claim 1, wherein the polyethylene multifilament interlaced yarn has a degree of entanglement of 30 to 40 nodes/m.

3. The polyethylene multifilament interlaced yarn of claim 1, wherein the polyethylene multifilament interlaced yarn has the tenacity of 13 to 20 g/d, the initial modulus of 100 to 250 g/d and the elongation of 7 to 10%, and wherein the polyethylene multifilament interlaced yarn is obtained by drawing the multifilament yarn provided using polyethylene chips at a total draw ratio of 11 to 23 times in multi-stage drawing of 4 stages or more and 20 stages or less using a plurality of godet rollers, followed by heat setting, wherein the drawn multifilament yarn is interlaced with an air pressure of 30 to 70 psi, and wherein the polyethylene chips have a polydispersity index (PDI) of more than 5 and 9 or less and a melt index (MI at 190° C.) of 0.3 to 3 g/10 min.

4. The polyethylene multifilament interlaced yarn of claim 1, comprising 40 to 500 filaments, wherein each filament has a fineness of 1 to 3 denier, and the polyethylene multifilament interlaced yarn has a total fineness of 100 to 1,000 denier.

5. A method of manufacturing the polyethylene multifilament interlaced yarn of claim 1, comprising the steps of:

obtaining a polyethylene melt by melting polyethylene chips having a polydispersity index (PDI) of more than 5 and 9 or less and a melt index (MI at 190° C.) of 0.3 to 3 g/10 min;

extruding the polyethylene melt through a spinneret having a plurality of nozzle holes;

quenching a plurality of filaments formed when the polyethylene melt is discharged from the nozzle holes;

forming a multifilament yarn by collecting the plurality of quenched filaments;

drawing the multifilament yarn at a total draw ratio of 11 to 23 times, followed by heat setting;

interlacing the drawn multifilament yarn; and winding the interlaced multifilament yarn to provide the polyethylene multifilament interlaced yarn having a weight average molecular weight of 90,000 to 300,000 g/mol, wherein the interlacing step is performed with an air pressure of 15 to 100 psi, wherein the drawing step is performed in multi-stage drawing of 4 stages or more and 20 stages or less using a plurality of godet rollers.

6. The method of manufacturing the polyethylene multifilament interlaced yarn of claim 5, wherein 0 to 10% of a relax calculated by the following Equation 1 is applied to the drawn multifilament yarn:

$$R(\%)=[(V_{max}-V_w)/V_{max}]\times 100 \quad \text{[Equation 1]}$$

In Equation 1, R is a relax, $V_{max}$ is the highest linear velocity among linear velocities of godet rollers, and $V_w$ is a winding velocity.

7. The method of manufacturing the polyethylene multifilament interlaced yarn of claim 5, wherein a tension of 0.1 to 0.5 g/d is applied to the multifilament yarn during the interlacing step and the winding step.

8. The method of manufacturing the polyethylene multifilament interlaced yarn of claim 5, wherein the heat setting of the multifilament yarn is performed by the plurality of godet rollers.

9. The method of manufacturing the polyethylene multifilament interlaced yarn of claim 8, wherein the plurality of godet rollers are set to a temperature of 40 to 140° C., a temperature of the first godet roller among the plurality of godet rollers is 40 to 80° C., a temperature of the last godet roller among the plurality of godet rollers is 110 to 140° C., and a temperature of each godet roller other than the first and last godet rollers is equal to or higher than that of the preceding godet roller.

* * * * *